US007675467B2

(12) United States Patent
Park et al.

(10) Patent No.: US 7,675,467 B2
(45) Date of Patent: Mar. 9, 2010

(54) BENT MONOPOLE ANTENNA

(75) Inventors: Jong Ho Park, Gumi-si (KR); Sung Mo Hwang, Gumi-si (KR); Soon Bea Oh, Gumi-si (KR); Young Soon Lee, Gumi-si (KR); Ui Jung Kim, Gumi-si (KR)

(73) Assignee: Ohsung Electronics Co., Ltd., Gyeongsangbuk-Do (KR)

( * ) Notice: Subject to any disclaimer, the term of this patent is extended or adjusted under 35 U.S.C. 154(b) by 0 days.

(21) Appl. No.: 12/072,789

(22) Filed: Feb. 27, 2008

(65) Prior Publication Data

US 2008/0303743 A1 Dec. 11, 2008

(30) Foreign Application Priority Data

Jun. 11, 2007 (KR) ..... 10-2007-0056923

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS, 343/895, 702

See application file for complete search history.

(56) References Cited

U.S. PATENT DOCUMENTS 6,897,812 B2 * 5/2005 Huang ..... 343/700 MS 7,183,976 B2 * 2/2007 Wu et al. ..... 343/700 MS

FOREIGN PATENT DOCUMENTS

KR 10-2006-0094603 A 8/2006

OTHER PUBLICATIONS

Office Action dated Apr. 1, 2008 citing KR-10-2006-0094603-A in Korean Application No. 10-2007-0056923, filed Jun. 11, 2007.

Office Action dated Feb. 12, 2009 citing KR-10-2006-0094603-A in Korean Application No. 10-2007-0056923, filed Jun. 11, 2007.

* cited by examiner

*Primary Examiner*—Hoang V Nguyen

(74) *Attorney, Agent, or Firm*—Saliwanchik, Lloyd & Saliwanchik

(57) ABSTRACT

Provided is a bent monopole antenna. The bent monopole antenna includes a printed circuit board, an RF module, a feed line, and a main radiation pattern part and a sub-radiation pattern part. The RF module is installed the printed circuit board to generate an electrical signal. The feed line is connected to the RF module to deliver the electrical signal. The main radiation pattern part and the sub-radiation pattern part serve as a radiation pattern part connected to the feed line to generate an electromagnetic field (electromagnetic waves) using electrical signals applied thereto. The main radiation pattern part has a spiral (helical) pattern passing through the printed circuit board through a via.

14 Claims, 9 Drawing Sheets
(1 of 9 Drawing Sheet(s) Filed in Color)

BENT MONOPOLE ANTENNA

CROSS-REFERENCE TO RELATED APPLICATION

The present application claims the benefit under 35 U.S.C. §119 of Korean Patent Application No. 10-2007-0056923, filed Jun. 11, 2007, which is hereby incorporated by reference in its entirety.

BACKGROUND

An antenna includes a transmission line transmitting signals of a radio frequency module, a radiating part for electromagnetic radiation, and a sub-radiation pattern part that can be regarded as an effective parasitic element having controllable impedance matching and radiation pattern.

Since a helical antenna can be miniaturized for a specific frequency band, and has a high efficiency, it is widely used for miniature wireless apparatuses. However, to use a helical antenna having a shape similar to that of a spring, a space for mounting the antenna must be secured inside a product, and a separate assembling process is required.

Also, since there is a possibility that the shape of the antenna is modified or the performance of the antenna changes depending on an outside environment, deviation in the performance of the antenna may be generated during the separate assembling process of the antenna.

BRIEF SUMMARY

Embodiments of the present invention provide a flat monopole antenna combined with a planar helical structure and having a bent shape. Particular embodiments provide a bent monopole antenna manufactured in a radio frequency (RF) module printed circuit board (PCB) using a conductor pattern.

In one embodiment, a bent monopole antenna includes: a printed circuit board; a radio frequency module provided to the printed circuit board and generating an electrical signal; a feed line connected with the radio frequency module and to which the electrical signal is delivered; and a main radiation pattern part and a sub-radiation pattern part as pattern parts connected to the feed line and generating one of an electromagnetic field and electromagnetic waves using the electrical signal applied thereto, the main radiation pattern part having a spiral (helical) pattern passing through the printed circuit board through a via.

The details of one or more embodiments are set forth in the accompanying drawings and the description below. Other features will be apparent from the description and drawings, and from the claims.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION

A bent monopole antenna will be described in detail with reference to the accompanying drawings.

Figure 1:
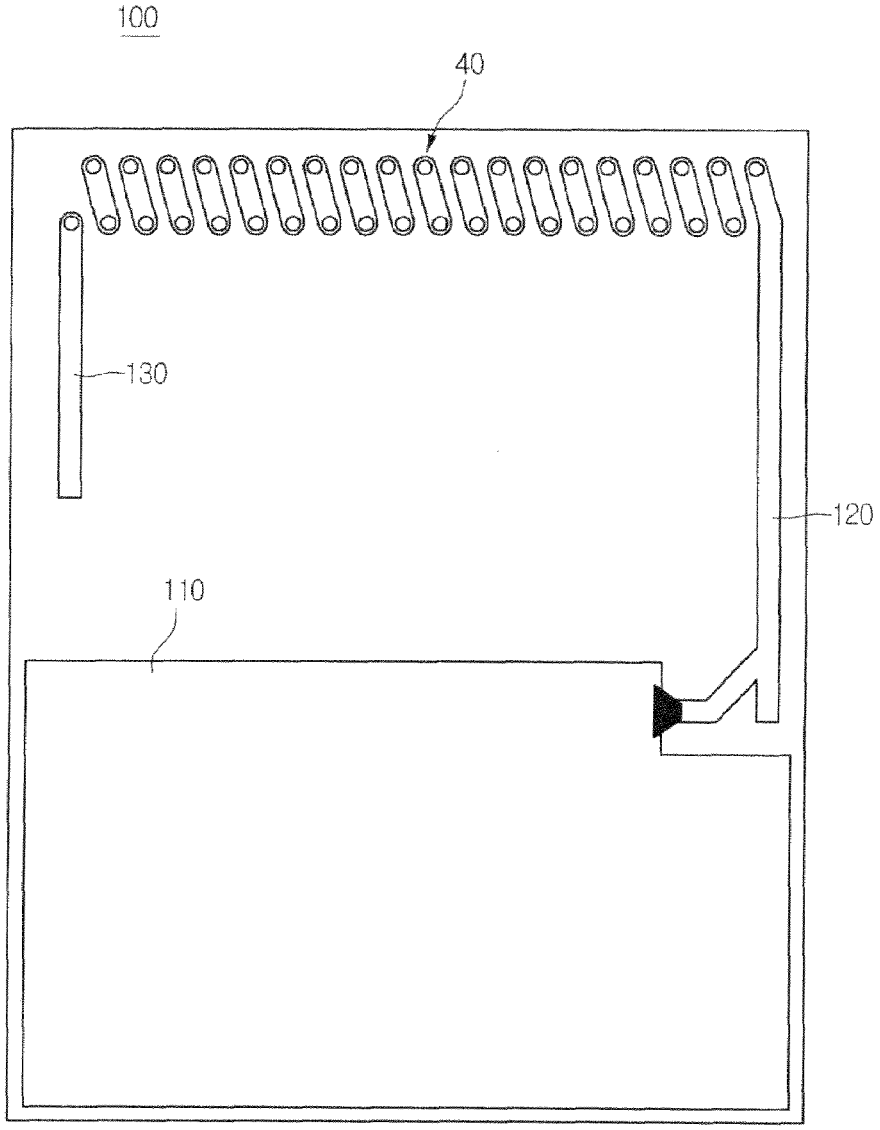
FIG. 1 is a view illustrating an upper side of a PCB according to an embodiment of the present invention.

FIG. 1 is a view illustrating an upper side of a PCB according to an embodiment of the present invention.

Referring to FIG. 1, a bent monopole antenna 100 according to an embodiment of the present invention includes a part mounting part 110 on which a predetermined radio frequency (RF) circuit is mounted, a feed line 120 through which an electrical signal of the part mounting part 110 is supplied, and a conductor plate on which the part mounting part 110 and the feed line 120 are seated.

Also, the bent monopole antenna 100 further includes a main radiation pattern part 40 and a sub-radiation pattern part 130 allowing an electromagnetic field (electromagnetic waves) to be radiated using an electrical signal applied to the feed line 120. The main radiation pattern part 40 and the sub-radiation pattern part 130 can be formed as patterns on a PCB.

Also, the main radiation pattern part 40 can be formed to have a bent shape to increase an antenna gain. According to an embodiment, the sub-radiation pattern part 130 is located and connected at the end of an open terminal of the main radiation pattern such that an electrical signal applied to the main radiation pattern part 40 can be also applied to the sub-radiation pattern part 130. Since the intensity of a current applied to the sub-radiation pattern part 130 is relatively very small compared to an intensity of a current applied to the main radiation pattern part 40, the sub-radiation pattern part 130 can be regarded as an effective parasitic element.

The shapes of the main radiation pattern part 40 and the sub-radiation pattern part 130 are described later with reference to the accompanying drawings.

In an embodiment, the feed line 120 supplies electrical signals to a radiation device, which is a structure designed to radiate electromagnetic waves to a space via the antenna. Also, a conductor can be directly connected to the radiation device, or electrical signals can be supplied to the radiation device through no-contact point capacitance coupling.

Also, the part mounting part 110 can include a device converting a predetermined electrical signal to a signal having a frequency in a predetermined RF channel, and outputting the same to deliver the predetermined electrical signal to the feed line 120.

Meanwhile, the operation of a monopole antenna is described below according to an embodiment.

The part mounting part 110 supplies an electrical signal to the feed line 120 to allow a predetermined signal to be transmitted through a predetermined frequency band. The feed line 120 efficiently transmits the supplied electrical signal to the main radiation pattern part and the sub-radiation pattern part, so that electromagnetic waves can be radiated using a current applied to the pattern parts.

Figure 2:
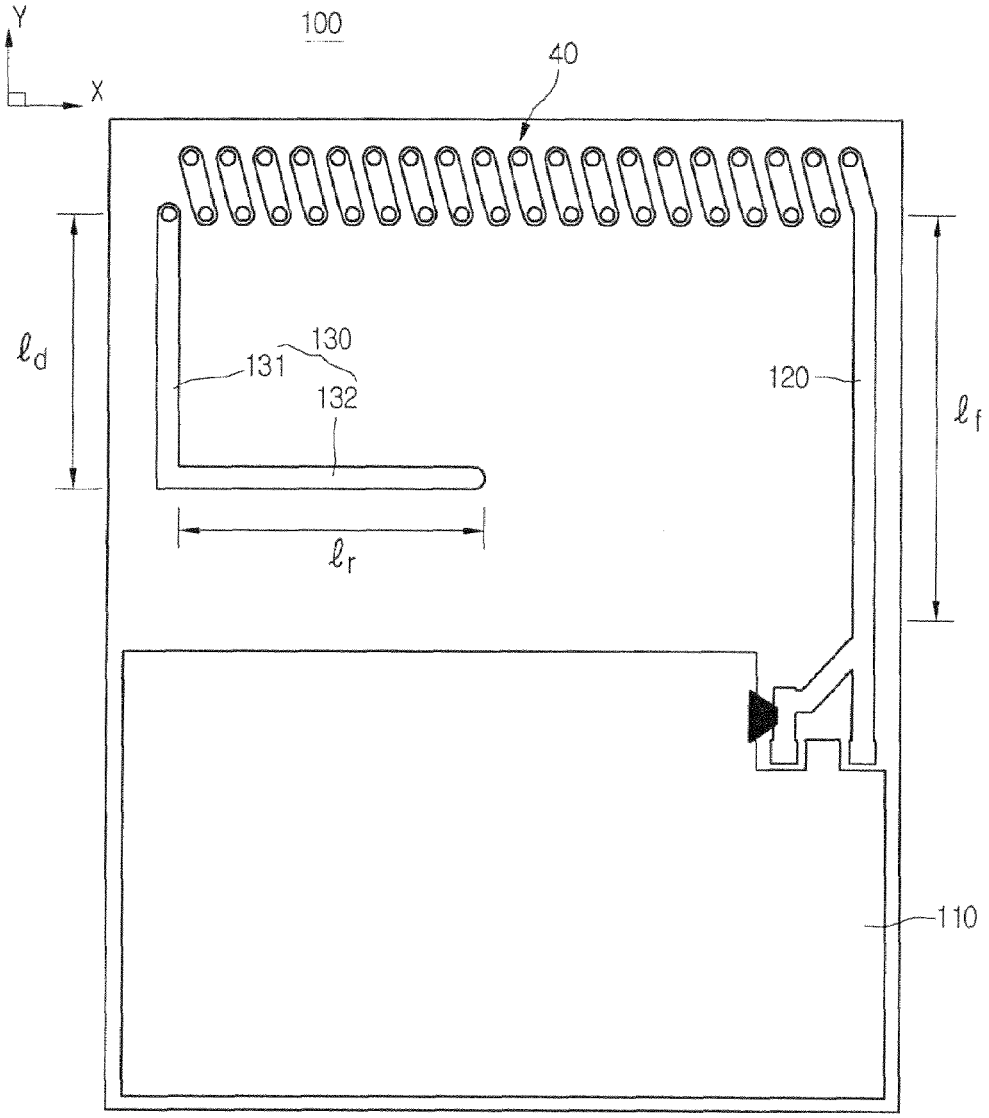
FIGS. 2 and 3 are views explaining the construction of a monopole antenna according to an embodiment of the present invention.
Figure 3:
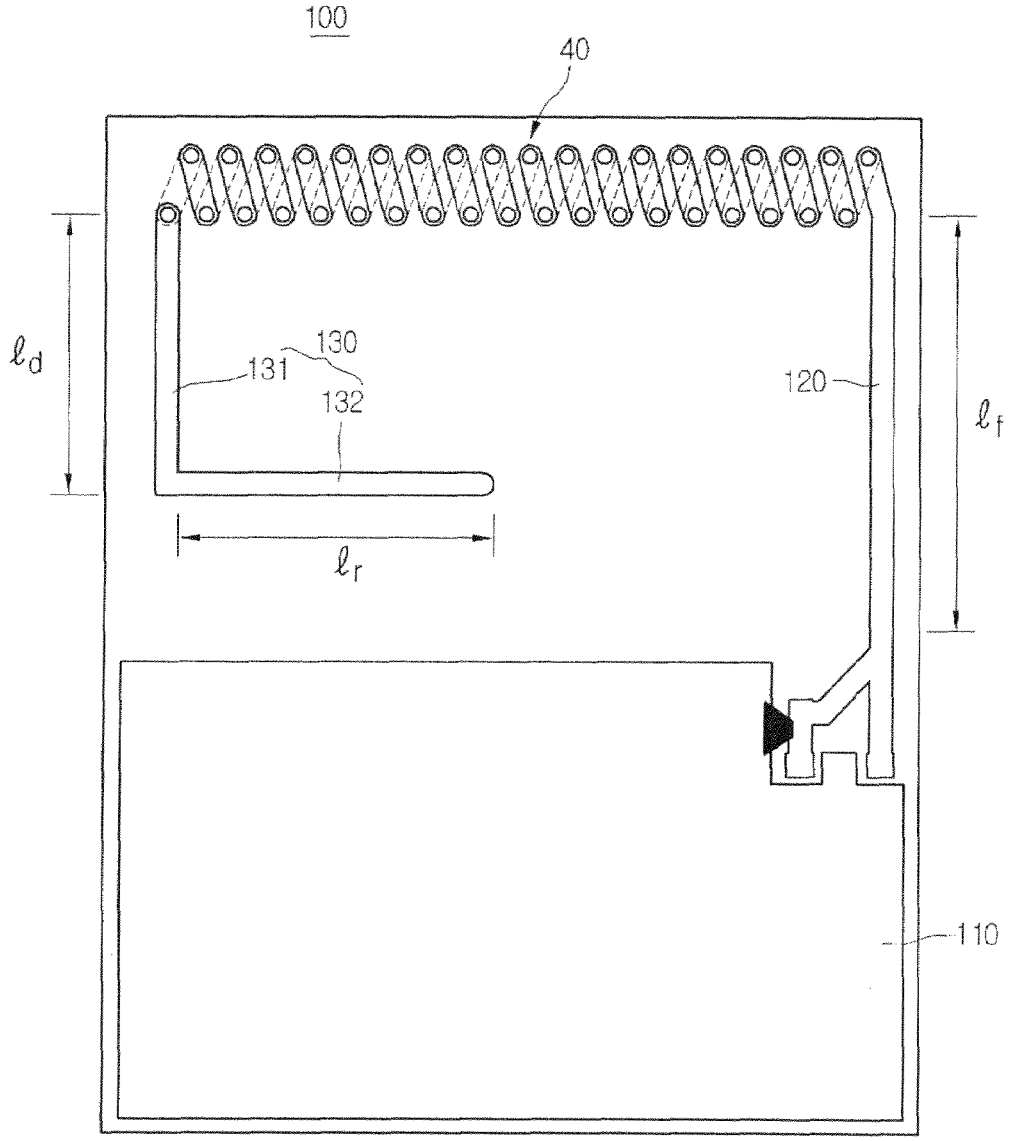

FIGS. 2 and 3 are views for explaining the construction of a monopole antenna according to an embodiment.

Figure 9:
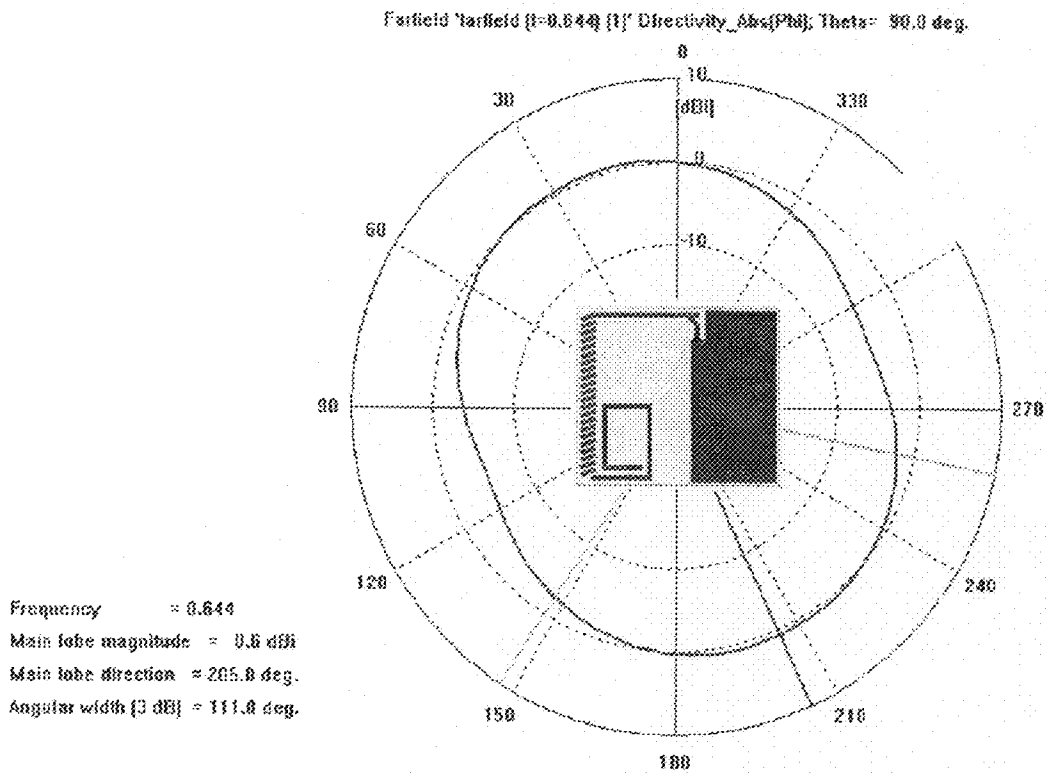
FIG. 9 is a view illustrating a vertical radiation pattern of a monopole antenna according to an embodiment of the present invention.

For reference, although the sub-radiation pattern part 130 has been illustrated to have a straight line shape in FIG. 1, the sub-radiation pattern part 130 can also have a bent shape, for example, as shown in FIGS. 2, 3, and 9. The shape of the sub-radiation pattern part 130 can be shaped different depending on the device to which the subject antenna is applied. The shape of the sub-radiation pattern part 130 allows a radiation pattern to have orientation. The radiation pattern is induced when the sub-radiation pattern part 130 reflects an electromagnetic field (electromagnetic waves) from the main radiation pattern part 40.

That is, referring to FIGS. 2 and 3, in the case where the sub-radiation pattern part 130 has a bent shape, an electromagnetic field (electromagnetic waves) from the main radiation pattern part 40 is also applied to the sub-radiation pattern part 130 to allow a current to flow through the sub-radiation pattern part 130. When the current flows through the sub-radiation pattern part 130, an electromagnetic field (electromagnetic waves) is generated. The radiation pattern induced by the electromagnetic field (electromagnetic waves) from the sub-radiation pattern part 130 has orientation.

In more detail, according to one embodiment, the sub-radiation pattern part 130 includes a first sub-radiation pattern 131 directly connected to the main radiation pattern part 40, and a second sub-radiation pattern 132 extending at an angle from one side of the first sub-radiation pattern 131. The electromagnetic field (electromagnetic waves) from the main radiation pattern 40 has an influence on the second sub-radiation pattern 132 to improve the orientation of the induced radiation pattern.

In FIG. 2, assuming that the arrangement direction of the main radiation pattern 40 is in an X-direction, the radiation direction of electromagnetic waves formed by electrical signals applied to the main radiation pattern part 40 and the electromagnetic field (electromagnetic waves) from the main radiation pattern part 40 is in a Y-direction perpendicular to the X-direction.

Particularly, the sub-radiation pattern part 130 can serve as an effective parasitic element. Since the effective parasitic element can make an electrical length of the antenna long, a resonance frequency can be lowered. Also, the addition of the second sub-radiation pattern 132 can make the longitudinal length of the antenna longer than one half of a wavelength to allow the input impedance of the total length of the antenna to have a capacitance component to cancel an inductance component of the main radiation pattern having a spiral structure. The input impedance of the antenna can be controlled by controlling the length of the sub-radiation pattern part 130. Accordingly, the sub-radiation pattern part 130 serves as an element that can control a radiation pattern.

The length of first sub-radiation pattern 131 is denoted by $\lambda_d$, and the length of the second sub-radiation pattern 132 is denoted by $\lambda_r$. The direction or size of an induced radiation pattern can be controlled by varying the lengths of the first sub-radiation pattern 131 and the second sub-radiation pattern 132, which can be checked through experimental data of the accompanying drawings.

FIG. 3 schematically illustrates the structure of the main radiation pattern according to an embodiment. The main radiation pattern 40 is formed in a pattern bent along the front side and the rear side of the PCB. The front side pattern and the rear side pattern of the PCB can be electrically connected to each other by a conductor passing through a via.

The shape of the main radiation pattern part 40 will be described in more detail with reference to FIGS. 4 and 5.

Figure 4:
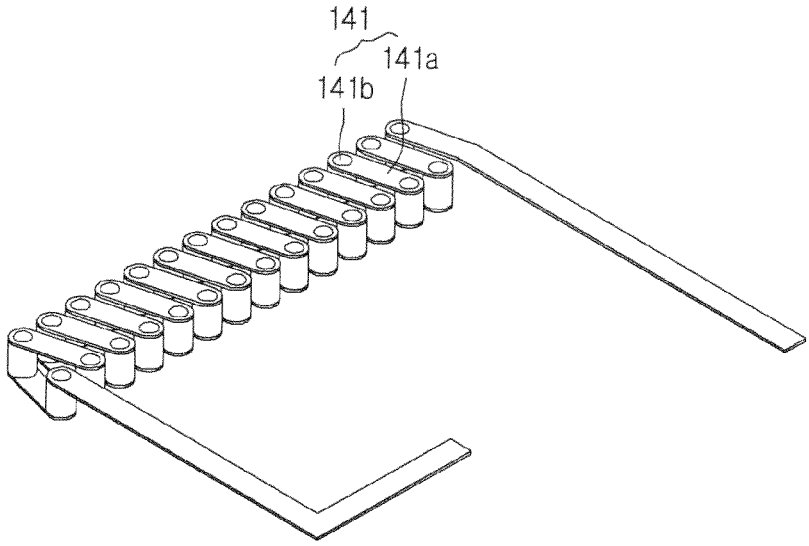
FIG. 4 is a schematic perspective view explaining a main radiation pattern part according to an embodiment of the present invention.
Figure 5:
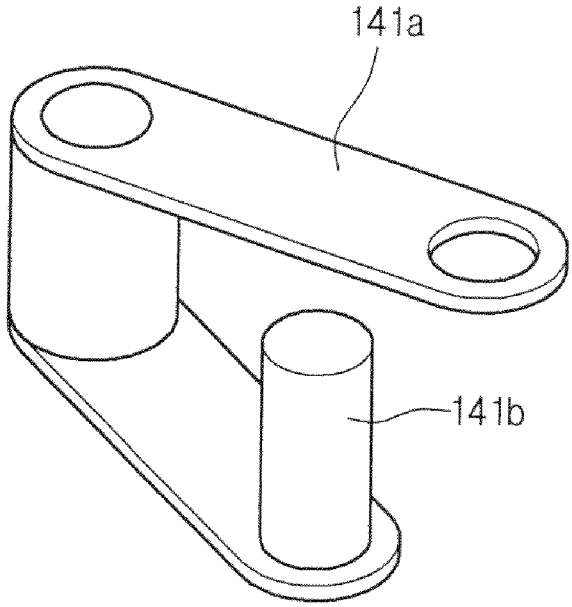
FIG. 5 is a view explaining the shape of a unit pattern forming the main radiation pattern part according to an embodiment of the present invention.

FIG. 4 is a schematic perspective view explaining a main radiation pattern part according to an embodiment, and FIG. 5 is a view explaining the shape of a unit pattern forming the main radiation pattern part.

Referring to FIGS. 4 and 5, each unit pattern 141 can generate an electric field (electromagnetic waves) using electrical signals applied thereto to radiate electro magnetic waves. According to one embodiment, each unit pattern 141 includes two printed patterns 141*a* and via patterns 141*b* electrically connecting the printed patterns 141*a*.

Particularly, each printed pattern 141*a* is formed as a pattern on the front side (or upper surface) or the rear side (or lower surface) of the PCB. The via pattern 141*b* is formed by forming a via hole in the PCB and processing a metal pattern of a conductor.

Since the main radiation pattern part includes a plurality of unit patterns, the antenna can be formed long in a limited space, so that an antenna gain can be increased.

Figure 6:
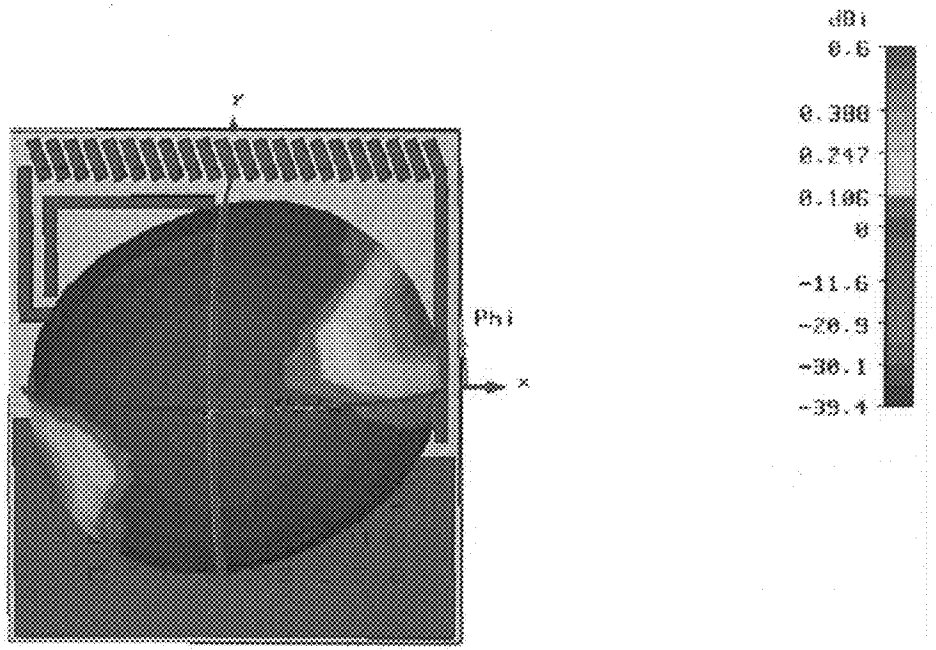
FIG. 6 is a view illustrating for 3-dimensions a radiation pattern of a monopole antenna according to an embodiment of the present invention.
Figure 7:
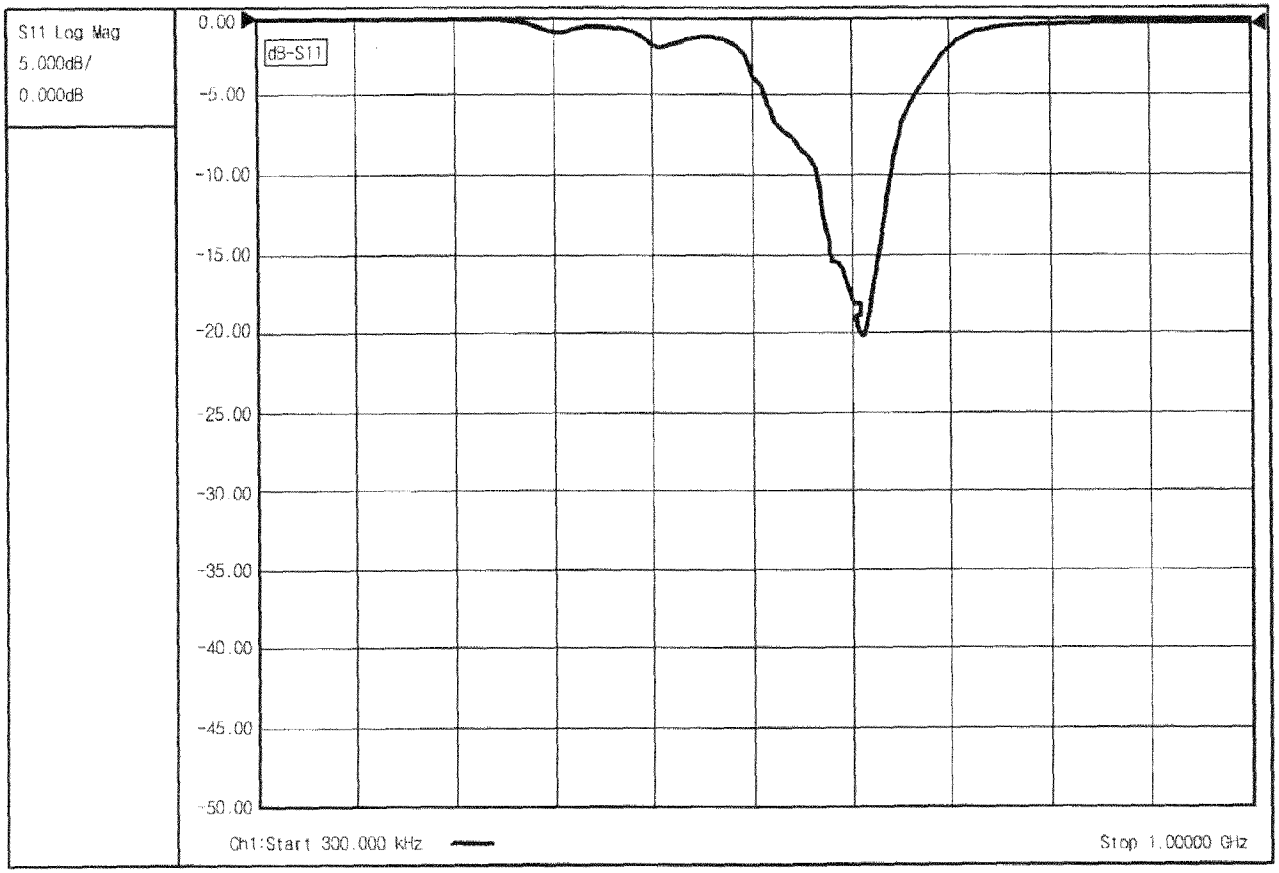
FIG. 7 is a graph illustrating a return loss characteristic of a monopole antenna according to an embodiment of the present invention.
Figure 8:
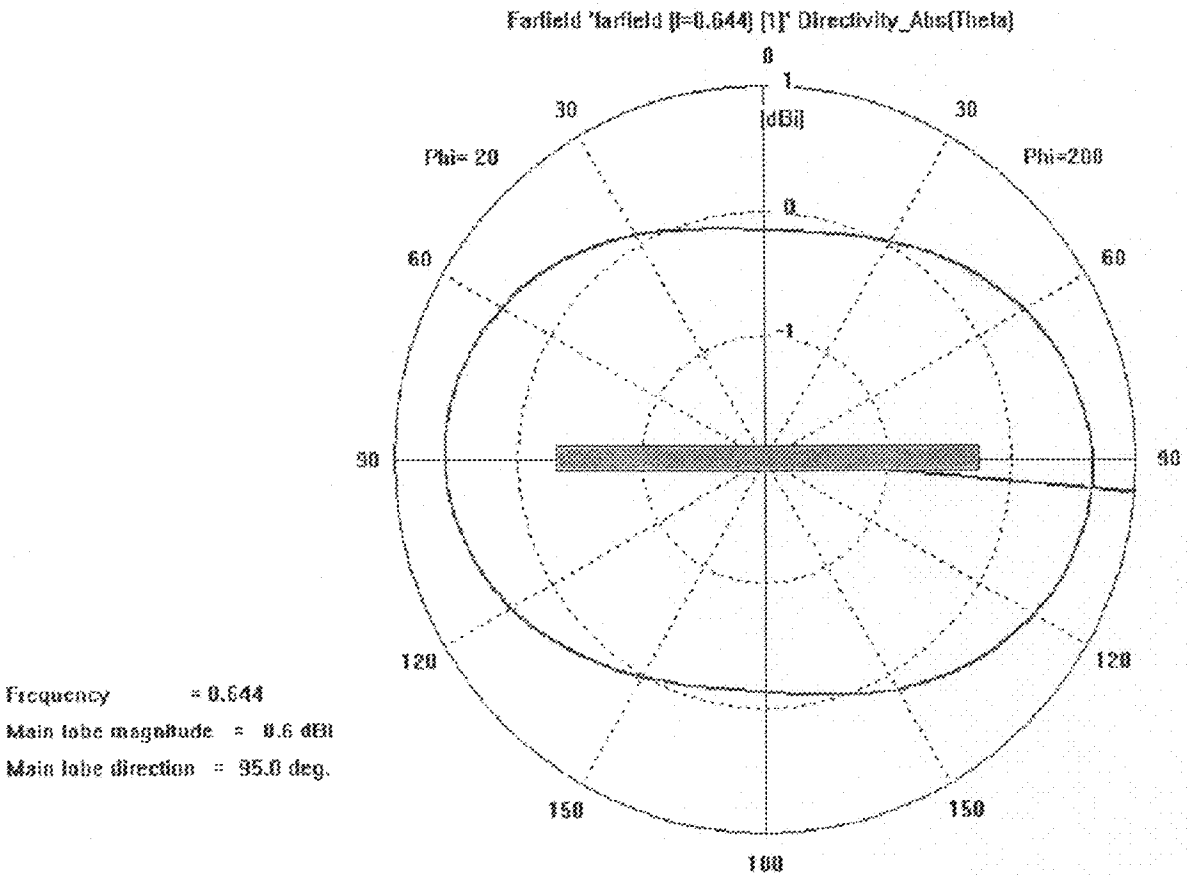
FIG. 8 is a view illustrating a horizontal radiation pattern of a monopole antenna according to an embodiment of the present invention.

FIG. 6 is a view illustrating for 3-dimensions a radiation pattern of a monopole antenna according to an embodiment, FIG. 7 is a graph illustrating a return loss characteristic of a monopole antenna according to an embodiment, FIG. 8 is a view illustrating a horizontal radiation pattern of a monopole antenna according to an embodiment, and FIG. 9 is a view illustrating a vertical radiation pattern of a monopole antenna according to an embodiment.

Referring to FIG. 6, due to electromagnetic wave generation and the function of an effective parasitic element between the main radiation part and the sub-radiation pattern part according to a proposed embodiment, horizontal radiation becomes greater than vertical radiation with respect to the PCB using an antenna according to an embodiment of the present invention.

Referring to FIG. 7, a return loss result shows that a return loss characteristic of—20.23 dB is resulted at an applied frequency.

Referring to FIG. 8, a horizontal radiation pattern of the antenna according to a proposed embodiment has a main lobe size of 0.6 dBi at a frequency of 644 MHz. In the case where the PCB is disposed such that the main radiation pattern part is located to the left, the direction of the main lobe is 205.0 deg.

Referring to FIG. 9, a vertical radiation pattern of the antenna according to an embodiment has a main lobe size of 0.6 dBi at a frequency of 644 MHz.

According to certain embodiments, a related art helical antenna can be effectively replaced by a planar PCB antenna, and an antenna gain can be increased even in a narrow space of the PCB on which parts are mounted.

Also, the sub-radiation pattern part can operate as an effective parasitic element, so that the orientation of the radiation pattern of the antenna can be further improved in an embodiment of the present invention.

The antenna according to embodiments of the present disclosure can be realized in a bent antenna on a PCB by combining a related art monopole antenna with a planar helical antenna, and provides the following characteristics.

First, since an antenna is not separately manufactured but is directly manufactured an RF module PCB, a manufacturing process is simplified. Also, a space required for mounting the antenna can be effectively minimized. Unlike a related art monopole antenna having a length of one fourth of a wavelength, the antenna according to the present disclosure can have a length of one half of a wavelength, so that current can be maximized at the main radiation pattern part. Also, the antenna having the main radiation pattern part in the form of a helical structure and thus generating electromagnetic waves of elliptical polarized waves can also serve as a diversity antenna for polarized waves, which are advantageous in fading in an indoor environment. Also, the bent sub-radiation pattern part can serve as a reflector in the form of an effective parasitic element.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bent monopole antenna comprising:

a printed circuit board;

a radio frequency module generating an electrical signal on the printed circuit board;

a feed line formed on the printed circuit board and connected with the radio frequency module and to which the electrical signal is delivered; and a main radiation pattern part connected to the feed line and generating electromagnetic waves using the electrical signal applied from the radio frequency module, wherein the main radiation pattern part includes printed patterns on both sides of the printed circuit board and via patterns passing through the printed circuit board to connect the printed patterns in the form of a helical structure; and a sub-radiation pattern part reflecting the electromagnetic waves induced from the main radiation pattern part.

2. The bent monopole antenna according to claim 1, wherein the sub-radiation pattern part comprises a first sub-radiation pattern connected to the main radiation pattern part, and a second sub-radiation pattern bent from one side of the first sub-radiation pattern.

3. The bent monopole antenna according to claim 2, wherein the second sub-radiation pattern is disposed between the radio frequency module and the main radiation pattern part.

4. The bent monopole antenna according to claim 2, wherein the main radiation pattern part is extended in an X-direction, and wherein the first sub-radiation pattern is extended in a Y-direction perpendicular to the X-direction, and wherein the second sub-radiation pattern is extended in the X-direction.

5. The bent monopole antenna according to claim 4, wherein the second sub-radiation pattern is overlapped with the main radiation pattern part in the Y-direction.

6. The bent monopole antenna according to claim 4, wherein the first sub-radiation pattern is overlapped with the feed line in the X-direction.

7. The bent monopole antenna according to claim 1, wherein a total length of the main radiation pattern part and the sub-radiation pattern part is longer than one half of the wavelength of the electromagnetic waves.

8. A bent monopole antenna comprising:

a printed circuit board having a first surface and s second surface;

a radio frequency module on the printed circuit board;

a feed line formed on the printed circuit board and connected to the radio frequency module;

a main radiation pattern part connected to the feed line and generating electromagnetic waves, wherein the main radiation pattern part includes first printed patterns arranged in an X-direction on the first surface, second printed patterns arranged in the X-direction on the second surface, and via patterns passing through the printed circuit board to connect the first printed patterns and the second printed patterns, wherein each of the first printed patterns is slant in a first direction and each of the second printed patterns is slant in a second direction different from the first direction, and wherein the first printed patterns, second printed patterns and via patterns form one current path; and a sub-radiation pattern part connected to the main radiation pattern part on the first surface, wherein the sub-radiation pattern part is extended in the X-direction.

9. The bent monopole antenna according to claim 8, wherein the sub-radiation pattern part comprises a first sub-radiation pattern connected to the main radiation pattern part and a second sub-radiation pattern bent from one side of the first sub-radiation pattern.

10. The bent monopole antenna according to claim 9, wherein the second sub-radiation pattern is disposed between the radio frequency module and the main radiation pattern part.

11. The bent monopole antenna according to claim 10, wherein the main radiation pattern part is extended in the X-direction, and wherein the first sub-radiation pattern is extended in a Y-direction perpendicular to the X-direction, and wherein the second sub-radiation pattern is extended in the X-direction.

12. The bent monopole antenna according to claim 11, wherein the second sub-radiation pattern is overlapped with the main radiation pattern part in the Y-direction.

13. The bent monopole antenna according to claim 11, wherein the first sub-radiation pattern is overlapped with the feed line in the X-direction.

14. The bent monopole antenna according to claim 8, wherein a total length of the main radiation pattern part and the sub-radiation pattern part is longer than one half of the wavelength of the electromagnetic waves.

* * * * *